US006333479B1

(12) United States Patent
Tai

(10) Patent No.: US 6,333,479 B1
(45) Date of Patent: Dec. 25, 2001

(54) DUAL IN-LINE TYPE FINGER-ACTUATED SWITCH

(76) Inventor: Chi-Long Tai, B1, No.31, Hsing-Tay Road, Ju-Pei City, Hsin-Chu Hsien (TW)

( * ) Notice: Subject to any disclaimer, the term of this patent is extended or adjusted under 35 U.S.C. 154(b) by 0 days.

(21) Appl. No.: 09/753,624

(22) Filed: Jan. 4, 2001

(51) Int. Cl.[7] ..... H01H 15/00
(52) U.S. Cl. ..... 200/550; 200/16 D
(58) Field of Search ..... 200/16 R–16 D, 200/547–550

(56) References Cited

U.S. PATENT DOCUMENTS 3,963,884 * 6/1976 Pollock ..... 200/16 D
4,132,874 * 1/1979 Bruni et al. ..... 200/16 F
4,454,391 * 6/1984 Olsson ..... 200/16 D
4,833,280 * 5/1989 Bingo et al. ..... 200/16 D
4,841,105 * 6/1989 Goodman et al. ..... 200/16 D
5,967,302 * 10/1999 Lin ..... 200/550

* cited by examiner

*Primary Examiner*—Michael Friedhofer
(74) *Attorney, Agent, or Firm*—Rosenberg, Klein & Lee

(57) ABSTRACT

A dual in-line type finger-actuated switch comprised of a top cover plate, a finger-actuated switch body, and slide buttons. The slide buttons have extending along both their left and right sides a semicircular rib and two semicircular grooves, while the top cover plate has along the bottom of both the left and right sides semicircular contour grooves and semicircular contour ridges for wave-profiled corrugated contact and engagement such that the entire structure does not easily deform, thereby prolonging the service life and increasing the practical manufacturing value of the present invention.

1 Claim, 7 Drawing Sheets

DUAL IN-LINE TYPE FINGER-ACTUATED SWITCH

BACKGROUND OF THE INVENTION

1) Field of the Invention

The invention herein relates to a dual in-line type finger-actuated switch comprised of a top cover plate, a finger-actuated switch body, and slide buttons that provides a dual in-line type finger-actuated switch having dimensions of 11.5 mm ×5 mm ×2.3 mm and a plurality of slide buttons in which the top cover plate and the slide buttons are re-designed such that the overall assembled structure does not easily deform, has a prolonged service life and, furthermore, reduces production defect rates and increases practical manufacturing value.

2) Description of the Prior Art

In a modern technological society, all industries pursue advanced technological development to manufacture products that are ever more compact in size and of greater precision. While the precision, reliability and quality of such products is emphasized, this involves a higher degree of difficulty during production as well as the associated defect rate problems. These problems illustrate why the prices of high technology products remain high. The most obvious occurrence of the said phenomenon has to do with the electronic components in the products. Since the dual in-line type finger-actuated switch of the invention herein is commonly utilized in a wide range of high technology electronic products, knowing how to enhance dual in-line type finger-actuated switch manufacturing technology will lower production costs and raise technological development levels. Conventional dual in-line type finger-actuated switches are comprised of a top cover, a lower base, and a plurality of slide buttons, with the said top cover constructed of a plastic material rectangular in shape and which has a plurality of slots formed to provide for the insertion of the slide buttons; the lower base consists of a body constructed of a plastic material formed with embedded terminals fabricated of a conductive material, with the embedded terminals aligned lengthwise along two sides of the body; a recess is formed within the body and one end of the terminals are exposed at the bottom inside the recess; the slide buttons are bodies constructed of a plastic material into which is embedded a contact terminal during fabrication; and the body is rectangular with a slide block at the top, with the contact terminals positioned lengthwise at the lower two ends of the body.

In the assembly of the said structure, the slide buttons are inserted into their slots from the bottom section of the top cover, the top surface of the bodies are against the bottom surface of the top cover, the slide blocks are exposed in the slots, and the top cover and the lower base are assembled into a single structural entity with the slide buttons situated in between them.

In the structure and operation of the said conventional dual in-line type finger-actuated switches, numerous shortcomings still remain, including:

1. In the conventional dual in-line type finger-actuated switch, since the bodies of the slide button are constructed of a plastic material and the contact terminals are constructed of a conductive material that is embedded into the slide buttons during fabrication, if the contact terminals are embedded at an angle, then the four points of contact of each contact terminal may be reduced to only three points of contact or even two points of contact, which disables the effective toggling function of the finger-actuated switch.

2. In the conventional dual in-line type finger-actuated switch, to enable the contact terminals along the two sides at the bottom sections of the slide buttons to become respectively positioned relative to the terminals fixed at the two sides of the lower base and thereby maintain optimal contact, the two ends of the top sections of the slide button bodies are aligned with the receding sections and the projecting sections in the top cover and oriented in the direction of sliding to achieve positioning at the contact terminals. However, when the slide buttons are actuated, since the slide buttons are situated in the receding sections and projecting sections of the top cover, the bodies of the slide buttons sink downward during the actuation process and squeeze against the contact terminals at the two bottom sides of the said slide buttons, and because the said contact terminals are thin metal tensile springs, they are subject to elastic fatigue following the repeated application of extremely high pressure, resulting in reduced contact friction and the serious shortcoming of poor contact; at the same time, this shortens the normal times of actuation possible during the service life of the said dual in-line type finger-actuated switch.
3. In the conventional dual in-line finger-actuated switch, the said slide buttons, the body, and the top cover are forced and squeezed during movement, causing the top cover to warp upward and become deformed, and thereby damaging the structure of the conventional dual in-line type finger-actuated switch.

In view of the existent shortcomings in conventional dual in-line type finger-actuated switch production technology and overall structure awaiting improvement, the inventor of the invention herein conceived and researched an innovative solution based on specialized knowledge and design experience gained from professional engagement in the related fields which culminated in the successful development of a dual in-line finger-actuated switch of improved structural design.

SUMMARY OF THE INVENTION

The primary objective of the invention herein is to provide a dual in-line type finger-actuated switch in which the top cover plate and the slide buttons are improved such that the entire assembled structure does not easily deform and, furthermore, is capable of electrical optimal contact, has a prolonged service life and, furthermore, reduces production defect rates and increases practical manufacturing value.

To enable the examination committee to further understand the innovations and advantages of the invention herein, the brief description of the drawings are presented below, followed by the detailed description of an embodiment of the present invention.

DETAILED DESCRIPTION OF THE INVENTION

Figure 1:
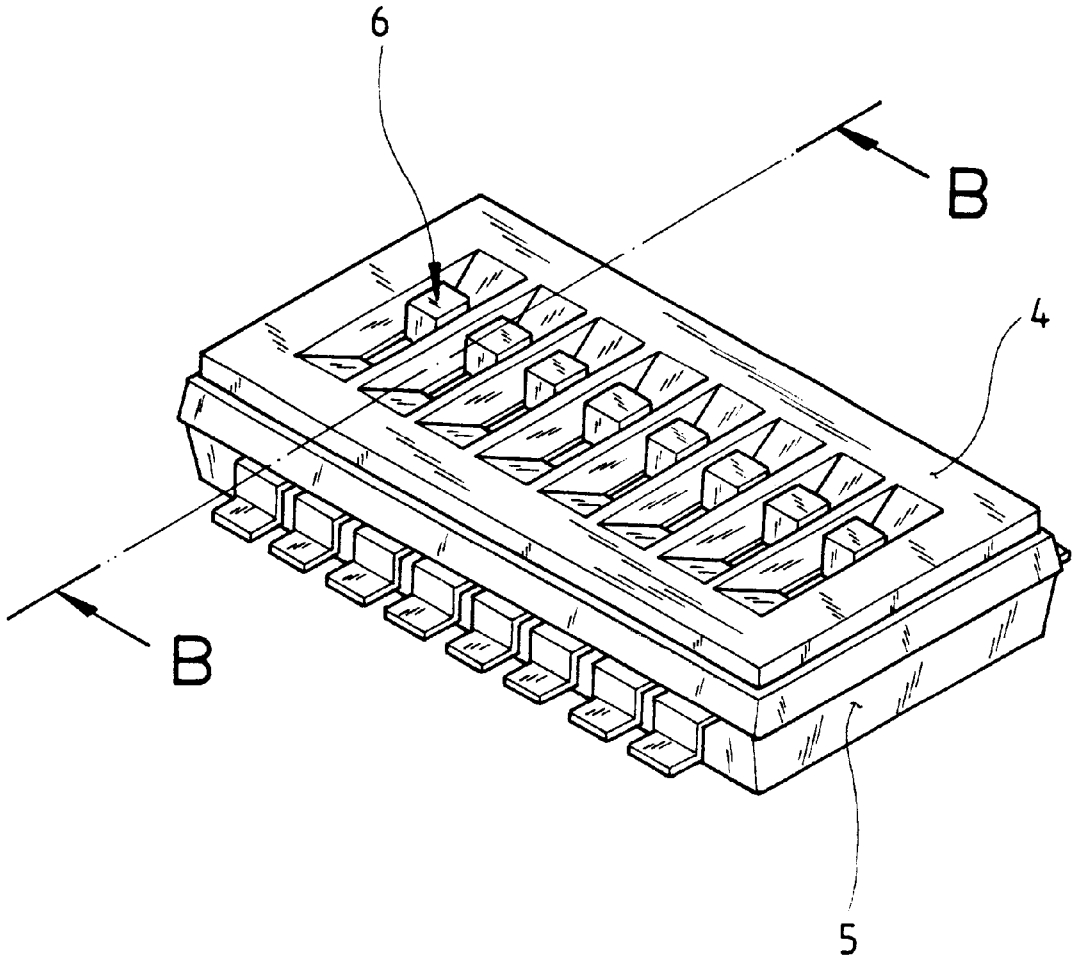
FIG. 1 is an isometric drawing of the assembled invention herein.
Figure 2:
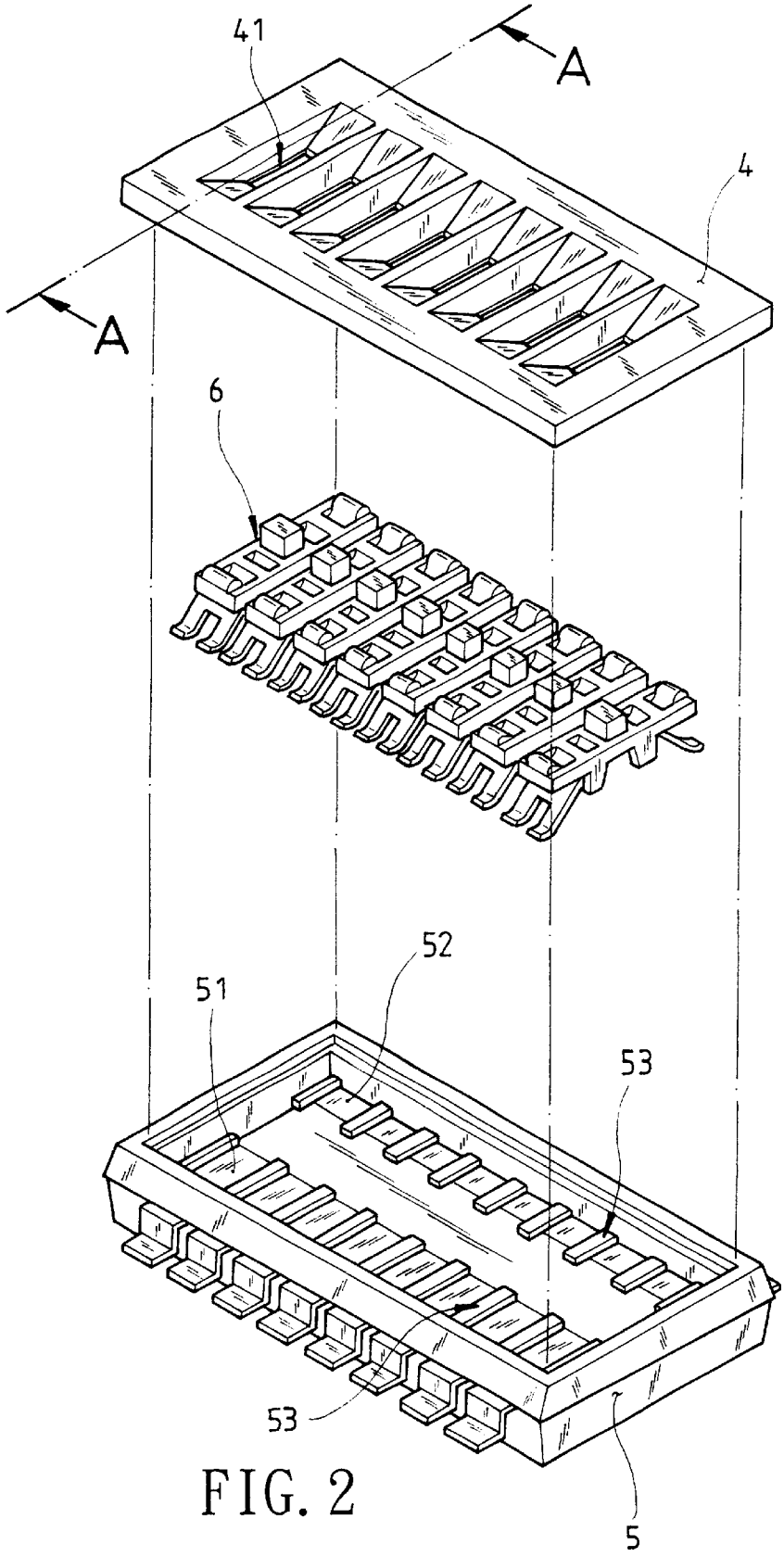
FIG. 2 is an exploded drawing of the invention herein.
Figure 3:
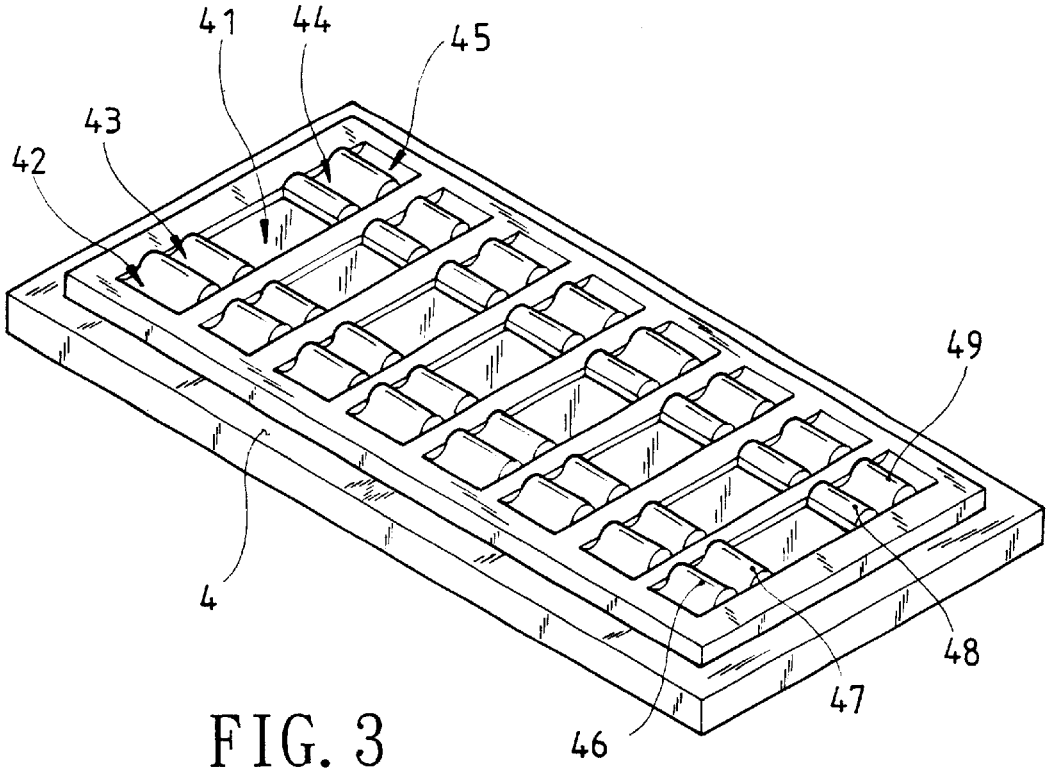
FIG. 3 is an isometric drawing of the back side of the cover plate.
Figure 4:
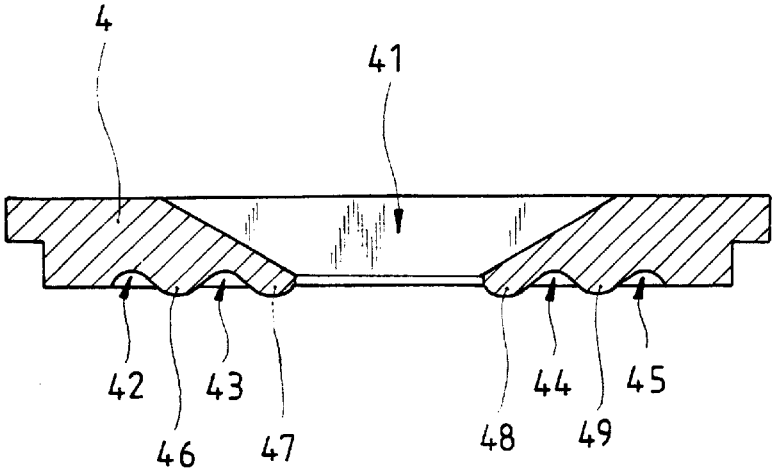
FIG. 4 is a cross-sectional drawing of FIG. 2 as viewed from the perspective of line A—A.

The dual in-line type finger-actuated switch of the invention herein is comprised of a top cover plate 4, a finger-actuated switch body 5, and slide buttons 6, referring to FIG. 1, wherein:

The top cover plate 4, as indicated in FIG. 2, FIG. 3, and FIG. 4, is constructed of a one-piece injection molded plastic material that is rectangular and flat in shape, with the said top cover plate 4 having a plurality of slots 41 (eight slots are shown in the drawings) formed along its center, and the surface at the left and right sides of the said slots 41 are beveled; furthermore, along the bottom of the left sides of the slots 41 of the said top cover plate 4 are two semicircular contour grooves 42 and 43 as well as two semicircular contour ridges 46 and 47 that form a wave-profiled detent corrugation and along the bottom of the right sides of the said slots 41 are semicircular contour grooves 44 and 45 as well as two semicircular contour ridges 48 and 49 that form a wave-profiled detent corrugation.

The finger-actuated switch body 5, as indicated in FIG. 2, is constructed of a one-piece injection molded plastic material that is a rectangular shaped frame, with a recess formed in the upper section of said finger-actuated switch body 5, and the said finger-actuated switch body 5 is aligned with the slots 41 of the said top cover plate 4, a plurality of contact pins 51 are inserted along the left side and, furthermore, the said contact pins 51 project from the exterior sides of the finger-actuated switch body 5 and are bent into a stepped-type arrangement; the said finger-actuated switch body 5 is aligned with the slots 41 of the said top cover plate 4; the said finger-actuated switch body 5 is aligned with the slots 41 of the said top cover plate 4, a plurality of contact pins 52 are inserted along the right side and, furthermore, the said contact pins 52 project from the exterior sides of the finger-actuated switch body 5 and are bent into a stepped-type arrangement. Furthermore, a plurality of stop blocks 53 respectively protrude from the two sides of the recess in the upper section of said finger-actuated switch body 5.

Figure 5:
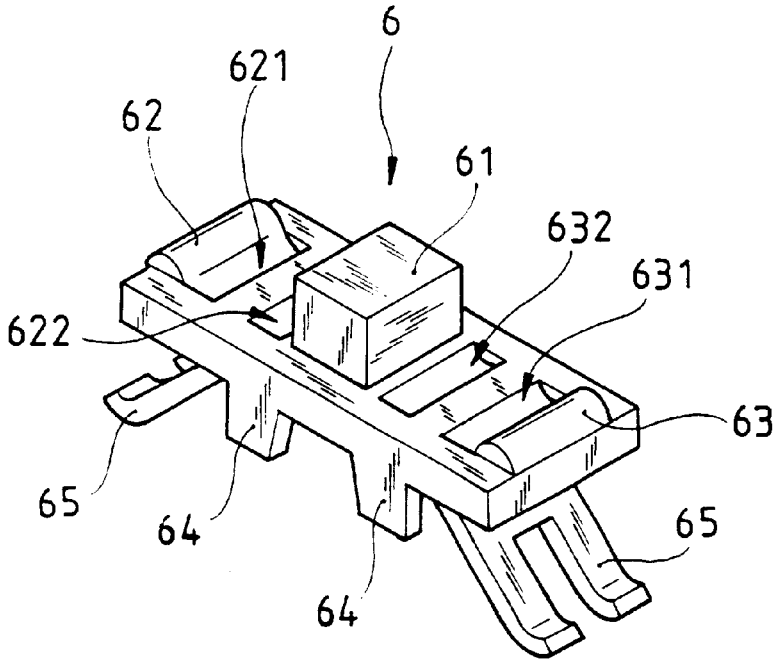
FIG. 5 is an isometric drawing of the slide button of the invention herein.
Figure 6:
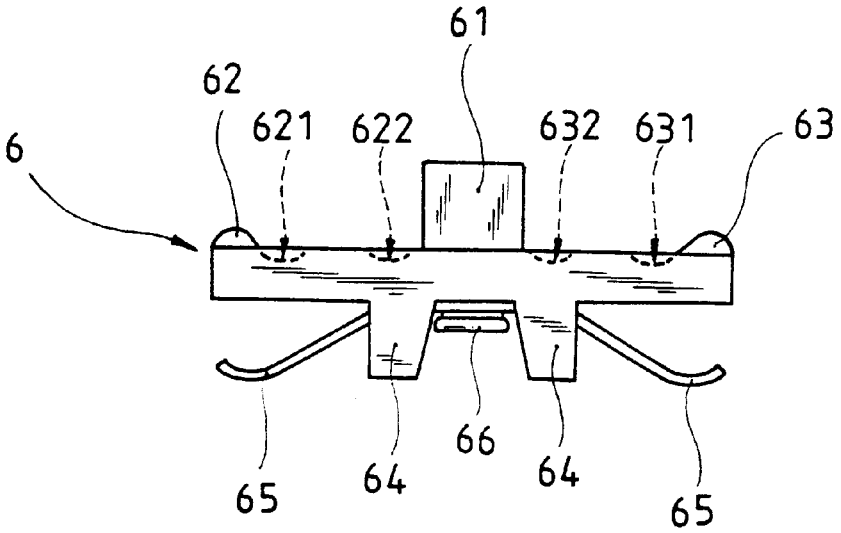
FIG. 6 is a cross-sectional drawing of the slide button of the invention herein.

The slide buttons 6, as indicated in FIG. 5 and FIG. 6, are constructed of one-piece injection molded plastic, and on the upper extent and rising from the center of each slide button 6 is a rectangular slide block 61 and, furthermore, extending along the left side is a semicircular rib 62 and two semicircular grooves 621 and 622 and extending along the right side is a semicircular rib 63 and two semicircular grooves 631 and 632; each said slide button 6 has protruding from its lower extent four support tabs 64; furthermore, affixed to the lower extent of each said slide button 6 is a flexible metal contact spring 65 and there is a hole (not shown in the drawings) in the center of the said contact spring 65 for the insertion of a mounting post 66 projecting from the center at the underside of the slide button 6 that is utilized to fasten the contact spring 65 onto the slide button 6.

Referring to FIG. 1 and FIG. 2, the invention herein consists of a plurality of slide buttons 6 arrayed in the recess formed at the upper section of the finger-actuated switch body 5 and, furthermore, the top cover plate 4 is conjoined to the upper edges of the finger-actuated switch body 5 such that the rectangular slide blocks 61 rising from the center of the slide buttons 6 extend through the slots 41 of the top cover plate 4, which enables assembly into a single structural entity.

Figure 7:
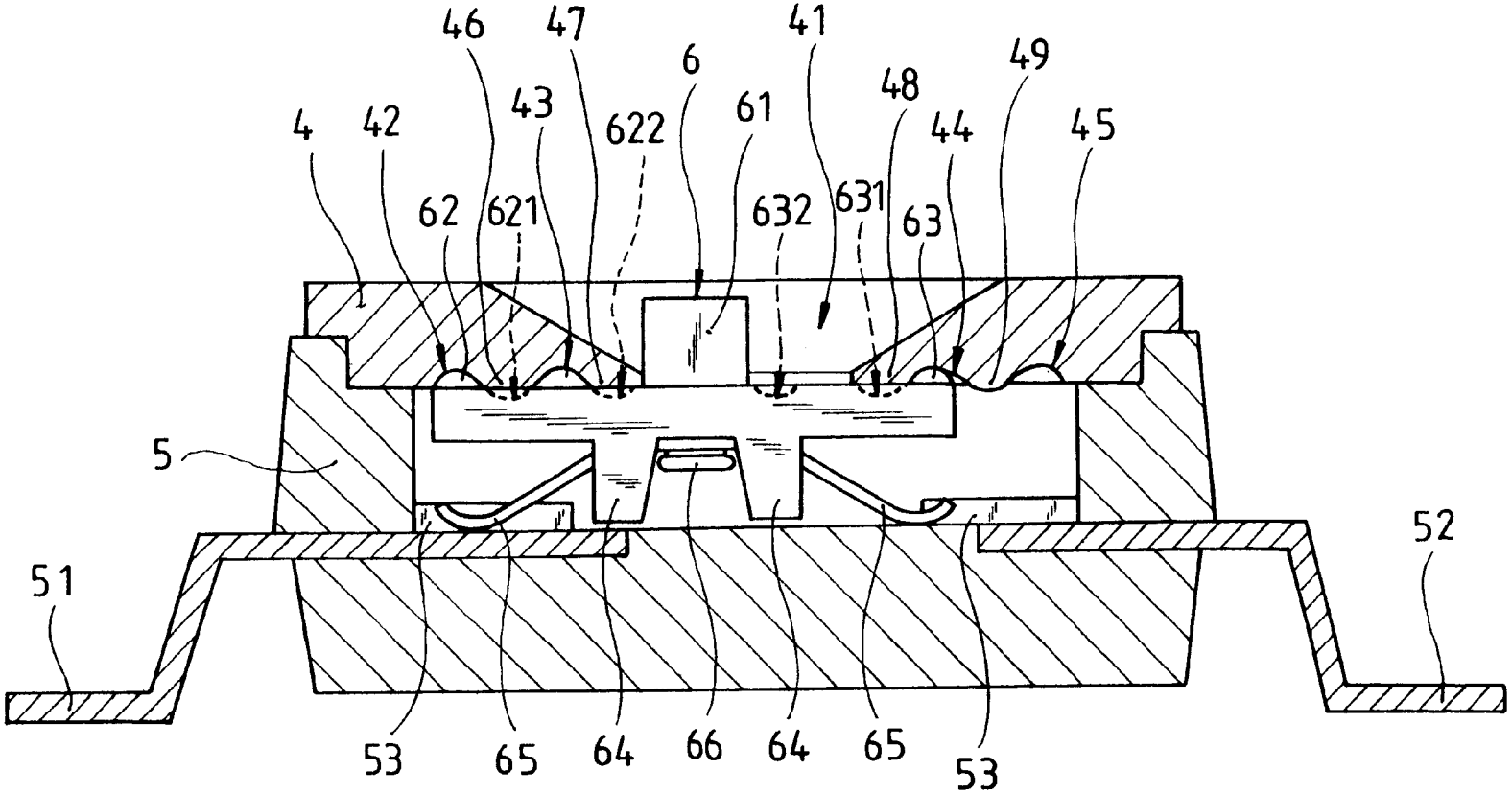
FIG. 7, FIG. 8, and FIG. 9 are cross-sectional drawings of the slide button area in corresponding positions as viewed from the perspective of line B—B in FIG. 1.
Figure 8:
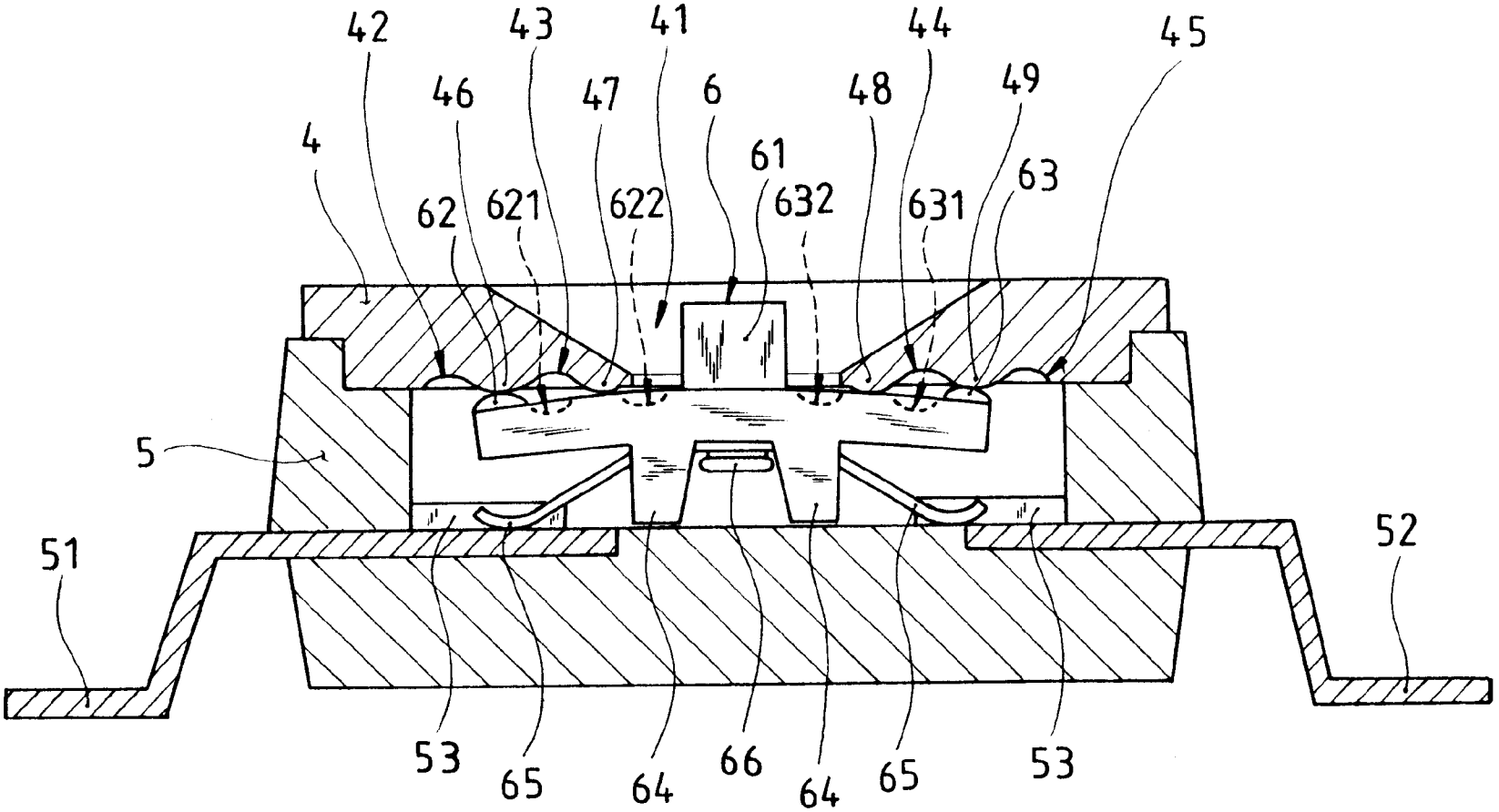
Figure 9:
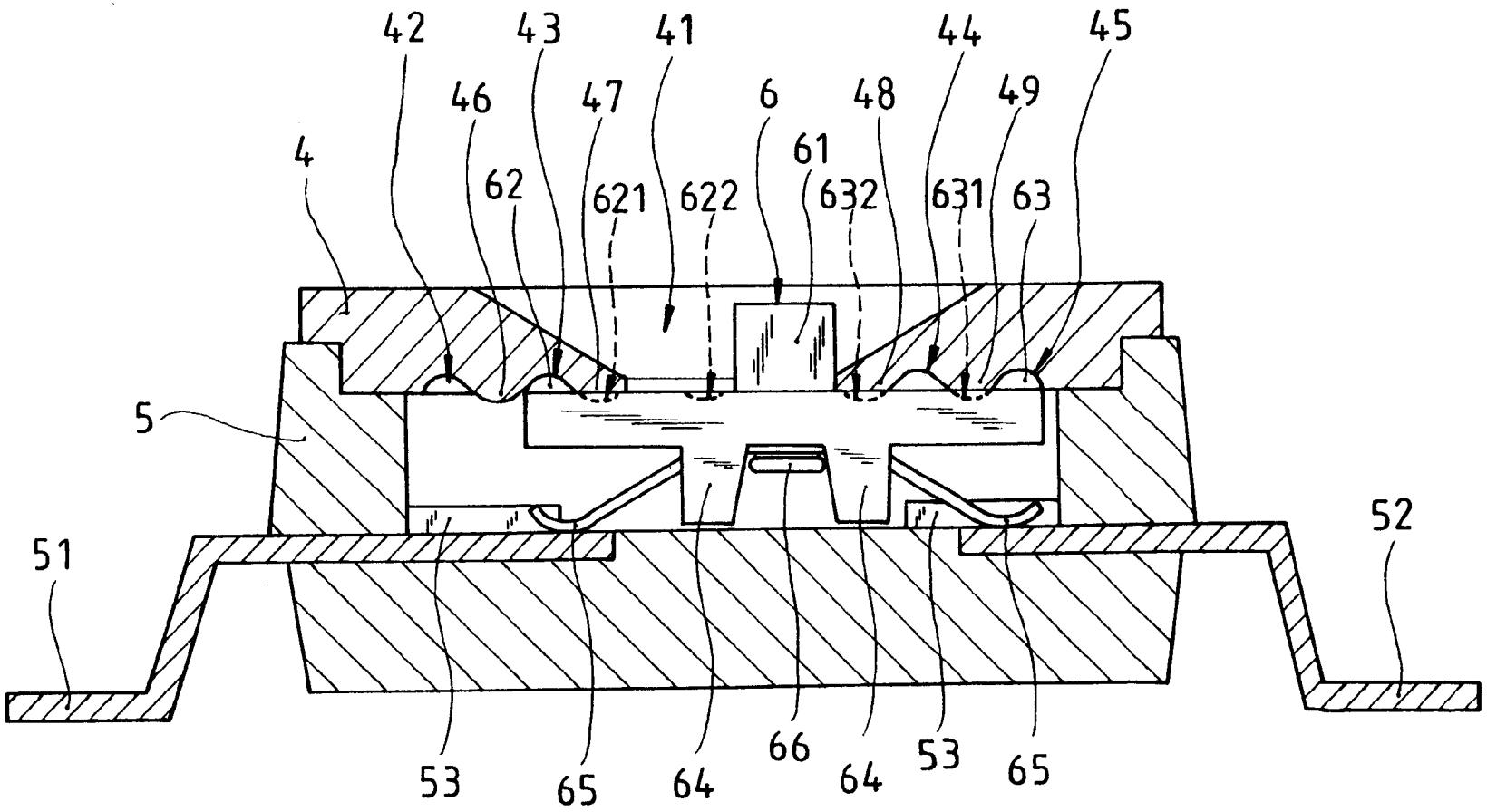

As indicated in FIG. 7, the semicircular rib 62 extending along the upper left side of the slide button 6 of the invention herein engages the semicircular contour groove 42 extending along the bottom left side of the top cover plate 4 and the two semicircular contour ridges 46 and 47 extending along the bottom left side of the top cover plate 4 engage the two semicircular grooves 621 and 622 extending along the upper left side of the slide button 6; the semicircular rib 63 extending along the upper right side of the said slide button 6 engages the semicircular contour groove 44 extending along the bottom right side of the top cover plate 4 and the semicircular contour ridge 48 extending along the bottom right side of the top cover plate 4 engages the semicircular groove 631 extending along the upper right side of the slide button 6; furthermore, electrical continuity is established between the left side of the contact spring 65 at the lower extent of the said slide button 6 and the contact pin 51 inserted through the left side of the finger-actuated switch body 5, however, there is no electrical continuity between the right sides of the contact springs 65 and the contact pins 52 inserted through the right side of the finger-actuated switch body 5. When the slide button 6 is pushed from left to right, as indicated in FIG. 8, the semicircular rib 62 and the two semicircular grooves 621 and 622 extending along the left side of the said slide button 6 become shifted into contact and engagement with the wave-profile corrugation formed by the two semicircular contour grooves 42 and 43 as well as the two semicircular contour ridges 46 and 47 extending along the bottom left side of the top cover plate 4; and the semicircular rib 63 and the two semicircular grooves 631 and 632 extending along the right side of the slide button 6 become shifted into contact and engagement with the wave-profile corrugation formed by the two semicircular contour grooves 44 and 45 as well as the two semicircular contour ridges 48 and 49 extending along the bottom right side of the top cover plate 4. When the slide button 6 is pushed to the right, as indicated in FIG. 9, the semicircular rib 62 extending along the left side of the said slide button 6 is engaged in the semicircular contour groove 43 along the bottom left side of the top cover plate 4 and the semicircular contour ridge 47 extending along the bottom left side of the top cover plate 4 is engaged in the semicircular groove 621 extending along the upper left side of the slide button 6; the semicircular rib 63 extending along the right side of the slide button 6 is engaged in the semicircular contour groove 45 extending along the bottom right side of the top cover plate 4 and the two semicircular contour ridges 48 and 49 extending along the bottom right side of the said top cover plate 4 are engaged in the two semicircular grooves 632 and 631 extending along the right side of the slide button 6; and, furthermore, electrical continuity is established between both the left and right side of the contact spring 65 at the lower extent of the said slide button and the contact pins 51 and 52 inserted through the finger-actuated switch body 5. Advantages and Effectiveness of the Invention 1. The flexible metal contact springs 65 fastened to the lower extents of the slide buttons 6 of the invention herein achieve stable and, furthermore, total electrical continuity with the contact pins 51 and 52 inserted through the finger-actuated switch body 5. 2. The semicircular ribs 62 and pairs of semicircular grooves 621 and 622 extending along the left sides of the slide buttons 6 become shifted into contact and engagement with the wave-profile corrugations formed by the pairs of semicircular contour grooves 42 and 43 as well as the two semicircular contour ridges 46 and 47 extending along the bottom left side of the top cover plate 4; the semicircular ribs 63 and the pairs of semicircular grooves 631 and 632 extending along the right sides of the said slide buttons 6 become shifted into contact and engagement the wave-profile corrugations formed by the two semicircular contour grooves 44 and 45 as well as the two semicircular contour ridges 48 and 49 extending along the bottom right side of the top cover plate 4, as so indicated by the structural features of the invention herein. The slide buttons 6 of the invention herein do not move downward during the actuation process because the slide buttons 6 have been re-designed into a double-sided nested toggling arrangement; in contrast, the slide buttons of conventional dual in-line type switches are displaced downward during the actuation process and, furthermore, squeeze down against the contact terminals at the two lateral bottom sections of the slide buttons; as such, the structure of the invention herein of an improved structure that obviously differs from the conventional technology. As a result, the contact springs 65 of the slide buttons 6 are not subjected to downward squeezing during the actuation process and capable of maintaining a normal contact angle and contact pressure; furthermore, an appropriate coefficient of friction is maintained between the contact springs 65 and the contact pins 51 and 52, while the application of inordinate operational force that deforms and damages the contact springs 65 is prevented, thereby increasing the precision switching repetitions of the product under normal usage and prolonging its service life and, furthermore, the flexible, wave-profiled detent contact operation at the two sides of the slide buttons 6, as indicated in FIG. 7, FIG. 8, and FIG. 9, are capable of effectively achieving positive engagement and, furthermore, a stable sliding action.

While the said structure of the invention herein is capable of achieving the claimed applications and performance, the detailed description of the most preferred embodiment only discloses the innovative features of the invention herein and shall not be construed as a limitation of the invention herein and, furthermore, all modifications and adaptations based on particulars of the disclosure herein shall remain within the scope and claims of the present invention.

In summation of the foregoing section, the invention herein is an original innovation among the same category of products and, furthermore, offers even greater application, performance, and practical value; furthermore, since an identical or similar product has not been disclosed on the market, the invention herein is submitted to the examination committee for review and the granting of the commensurate patent rights.

What is claimed is:

1. A dual in-line finger-actuated switch comprising:

a top cover plate formed of a one-piece injection molded plastic material having a substantially flat rectangular contour, said top cover plate having a plurality of centrally disposed slots formed therethrough, said top cover plate having an upper surface with a plurality of beveled portions respectively disposed on opposing ends of said plurality of slots, said top cover plate having a lower surface with a plurality of contoured ridges and grooves respectively formed on opposing ends of said plurality of slots to define a plurality of wave-shaped detents on said opposing ends of said slots;

a finger-actuated switch body formed in a rectangular contour of a one-piece injection molded plastic material and having a recess formed in an upper section thereof, said top cover plate being joined to said finger-actuated switch body to cover said recess, said finger-actuated switch body having a plurality of stop blocks formed in said recess, said plurality of stop blocks being disposed in spaced relationship on opposing sides of said finger-actuated switch body;

a plurality of contact pins inserted into said recess between respective pairs of said plurality of stop blocks of said finger-actuated switch body, each of said plurality of contact pins having a portion thereof projecting from a respective one of said opposing sides of said finger-actuated switch body, said projecting portion having a step-shaped contour;

a plurality of slide buttons disposed in said recess in respective aligned relationship with said plurality of slots, each of said slide buttons being formed of a one-piece injection molded plastic material and having a centrally disposed rectangular slide block extending from an upper side of said slide button, said upper side of said slide button having a rib and a pair of grooves on each of two sides thereof, each said slide button having a lower side with a centrally disposed mounting post and a plurality of support tabs extending therefrom, each of said rectangular slide blocks extending through a respective one of said slots; and, a plurality of flexible metal contact springs respectively coupled to said plurality of slide buttons, each of said flexible metal contact springs having a hole formed therethrough for coupling to a mounting post of a respective slide button;

whereby said ribs and pairs of grooves of said slide buttons in respective cooperation with said plurality of contoured ridges and grooves of said top cover plate provide a toggling contact action therebetween and prevent downward displacement of said flexible metal contact springs to maintain a predetermined contact angle thereof.

* * * * *